US008634585B2

(12) United States Patent
Farrell et al.

(10) Patent No.: US 8,634,585 B2
(45) Date of Patent: Jan. 21, 2014

(54) WEARABLE AUDIO CABLE MANAGEMENT SYSTEM

(75) Inventors: Brian Farrell, Quincy, MA (US); Daniel Fischbach, Woburn, MA (US); Richard Streeter, Andover, MA (US)

(73) Assignee: Foster-Miller, Inc., Waltham, MA (US)

( * ) Notice: Subject to any disclaimer, the term of this patent is extended or adjusted under 35 U.S.C. 154(b) by 60 days.

(21) Appl. No.: 12/931,763

(22) Filed: Feb. 10, 2011

(65) Prior Publication Data

US 2011/0228965 A1 Sep. 22, 2011

Related U.S. Application Data

(60) Provisional application No. 61/337,658, filed on Feb. 11, 2010.

(51) Int. Cl.
*H04R 25/00* (2006.01)

(52) U.S. Cl.
USPC ..... 381/384; 381/301; 381/333

(58) Field of Classification Search
USPC ..... 381/300, 301, 309, 333, 370, 376, 384, 381/385, 388; 2/209.13, 906; 379/430
See application file for complete search history.

(56) References Cited

U.S. PATENT DOCUMENTS

| | | | | |
|---|---|---|---|---|
| 4,589,134 | A * | 5/1986 | Waldron | 381/301 |
| 6,563,424 | B1 * | 5/2003 | Kaario | 340/572.1 |
| 6,823,171 | B1 | 11/2004 | Kaario | |
| 7,013,492 | B2 | 3/2006 | Hugh et al. | |
| 7,364,491 | B2 | 4/2008 | Updyke | |
| 2005/0054941 | A1 | 3/2005 | Ting et al. | |
| 2006/0062413 | A1 | 3/2006 | Wehrell | |
| 2008/0273734 | A1 | 11/2008 | Solland | |

FOREIGN PATENT DOCUMENTS

WO WO 2009/136345 A1 11/2009

OTHER PUBLICATIONS

Written Opinion for International Application No. PCT/US2011/000254, from the International Searching Authority, dated Apr. 8, 2011, 4 pgs. (unnumbered).

* cited by examiner

*Primary Examiner* — Huyen D Le
(74) *Attorney, Agent, or Firm* — Iandiorio Teska & Coleman, LLP

(57) ABSTRACT

A pocket on the garment is configured to store an audio playback device. A device dock is associated with the pocket. The device dock includes an audio connector connectable to the audio playback device. A jack dock is on the garment. The jack dock includes a headphone jack configured to connect to a headphone. An elongated stretchable textile data/power bus is integrated with the garment between the device dock and the jack dock.

14 Claims, 11 Drawing Sheets

WEARABLE AUDIO CABLE MANAGEMENT SYSTEM

RELATED APPLICATIONS

This application hereby claims the benefit of and priority to U.S. Provisional Application Ser. No. 61/337,658, filed on Feb. 11, 2010 under 35 U.S.C. §§119, 120, 363, 365, and 37 C.F.R. §1.55 and §1.78, incorporated by reference herein.

FIELD OF THE INVENTION

This invention relates to "wearable electronics", "wearable computers", "smart fabrics" and the like and more particularly a wearable audio cable management system.

BACKGROUND OF THE INVENTION

The idea of "wearable computers" and electronic circuits built entirely out of textiles to distribute data and power and designed to perform functions such as touch sensing was first fully described in a disclosure called "Smart Fabric, or Washable Computing" by E. Rehmi Post and Maggie Orth of the MIT Media Laboratory available on the Internet at http:/www.media.mit.edu%7EREHMI/fabric/index.html and also on pp. 167-168 of the Digest of Papers of the First IEEE International Symposium on Wearable Computers, Oct. 13-14, 1997 held in Cambridge, Mass.

Prior to the applicant's invention described herein, electrical or electronic components were sometimes fastened to articles of clothing or placed in pouches or pockets. Individual wires between these components were then fastened to the outside of the clothing or disposed partially or wholly in seams and the like. In this way, a user could "wear" an audio playback device, a cellular telephone, or similar type device connected to headphones, a headset, or a speaker and/or microphone located on the collar of a jacket.

The problem with this design is that the wires are separate from the textile material of the clothing. As a result, the wires are unsightly and uncomfortable, do not wear well, can catch and tangle on objects, reduce mobility, add weight, are not washable, and are not resistant to corrosion. In general, such a design is not very robust.

Therefore, those skilled in the art sought to integrate the electronic circuits and data and power conductors within the textile of the articles of clothing themselves. See the MIT disclosure referred to above and incorporated herein by this reference. In the MIT reference, metallic yarn forms the weft of the fabric and, running in the other direction, plain silk thread forms the warp of the fabric. Surface mount light emitting diodes (LED's), crystal piezo transducers, and other surface mount components are then soldered directly onto the metallic yarn.

But, since the metallic yarn only runs in one direction, communications and interconnections between the electronic devices can only take place in that direction. Worse, the individual metallic yarns which do not electrically interconnect two components must be cut to provide electrical isolation for the individual metallic yarns which do electrically interconnect two components. This design thus raises serious design concerns, namely manufacturability, shielding, and electrical interference. Moreover, the fabric including the soldered-on electronic components is delicate, cannot be washed, has no stretch, and is uncomfortable to wear. Finally, if the fabric is folded back on itself, an electrical short will occur. Thus, special insulative coatings or substrates must be used which further render the fabric uncomfortable to wear.

Others have designed textile fabrics with conductive fibers for electrically interconnecting two electronic components. See U.S. Pat. Nos. 6,080,690 and 5,906,004 incorporated herein by this reference. Again, the main idea is that the whole garment is made of this special fabric. As such, a sensor can be electrically connected to a controller right on the garment. Still, routing of the data or power between the devices is limited without extensive formation of electrical junctions in the fabric—a very cumbersome manufacturing process. In addition, such garments are also uncomfortable and cannot withstand repeated wash cycles. See also U.S. Pat. No. 3,414,666 incorporated herein by this reference.

Commonly owned U.S. Pat. No. 6,727,197, incorporated herein by this reference, discloses designs of textile materials with integrated data or power buses which are simple to manufacture, pleasing in appearance, comfortable, washable, which wear well, which do not add significant weight, which are corrosion resistant, which do not impede mobility, which exhibit high fatigue strengths, and which also properly meet or exceed the electrical interface and shielding requirements of the specific application, be it military or consumer-based.

Commonly owned U.S. Pat. No. 7,559,902 and U.S. Publication No. 2007/0299325, both incorporated by reference herein, disclose an improved physiological monitoring garment with an elongated stretchable textile data/power bus disposed in an elastic fiber having one or more sensors connected to it.

One conventional system provides channels within the garment for the user to thread the headphone wires therethrough. Another conventional system permanently stitches a conventional headphone extension cable into a conventional T-shirt for connection to an audio playback device and headphone with a shortened cable. Routing a standard headphone or other cable set into channels within a garment requires subsequent removal of the headphone and wires for garment cleaning purposes. Conventional headphone cables or other wiring may not be stretchable which may impede stretching when integrated with high performance stretch fabrics, such as Lycra® based spandex, and the like. Moreover, manufacturing of a garment with permanent cable headphone wires may require a difficult and cumbersome stitching process.

Conventional "wearable" devices may lack the ability to support and safely stow various electronic devices in a way which enhances the performance of the device and improves the user interface with the device without sacrificing the performance of the garment being worn by the user.

BRIEF SUMMARY OF THE INVENTION

It is therefore an objective in one aspect of the subject invention to provide, in one embodiment, a wearable audio cable management system with a pocket on the garment that secures an audio playback device at a convenient location on a garment that allows a user to view and control the audio playback device. The wearable audio cable management system also includes a device dock associated with the pocket that includes an audio connector that connects to the audio playback device and a jack dock with a headphone jack for connecting to a headphone(s). An integrated stretchable data/power bus eliminates the need to route headphone cables into channels of a garment, can be used with high performance fabrics, and is easier to manufacture.

This invention features a wearable audio cable management system including a garment having a front and a back. A pocket on the garment is configured to store an audio playback device. A device dock is associated with the pocket. The device dock includes an audio connector connectable to the audio playback device. A jack dock is on the garment. The jack dock includes a headphone jack configured to connect to a headphone. An elongated stretchable textile data/power bus is integrated with the garment between the device dock and the jack dock.

In one embodiment, the pocket and the device dock may be located on the front of the garment. The pocket and the device dock may be located on a lower front portion of the garment. The jack dock may be located on the back of the garment. The jack dock may be located near a neck portion of the garment. The device dock may include a housing defining a channel for securing the audio connector. The housing may include a subsystem configured to connect the audio connector to the data/power bus. The housing may include a shelf configured to position the audio playback device such that a jack device engages the audio connector. A cover may be attached to the housing. The housing may include a flange configured to secure the device dock to the garment. The jack dock may include a housing configured to secure the headphone jack therein. The housing may include a subsystem configured to connect the headphone jack to the data/power bus. The housing may include a flange configured to secure the jack dock to the garment. The garment may be tight-fitting. The garment may be loose-fitting.

This invention also features a wearable audio cable management system including a garment having a front and a back. A pocket on the front of the garment is configured to store an audio playback device. A device dock is associated with the pocket. The device dock includes an audio connector connectable to the audio playback device. A jack dock is on the back of the garment. The jack dock includes a headphone jack configured to connect to a headphone. An elongated stretchable textile data/power bus is integrated with the garment between the device dock and the jack dock.

In one embodiment, the jack dock may be located near a neck portion of the garment.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
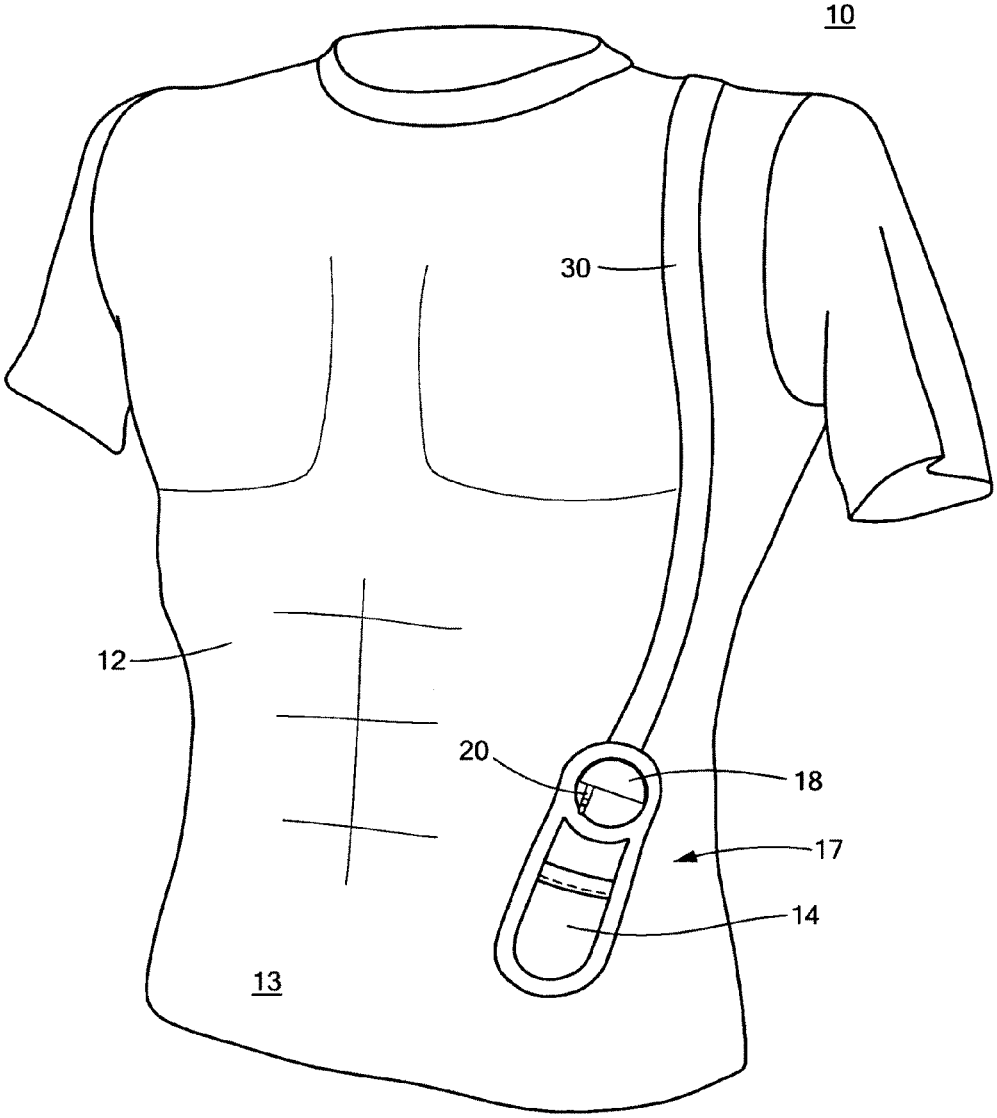
FIG. 1 is a schematic front-view of one embodiment of the wearable audio management system of this invention showing one example of the pocket for an audio playback device, a device dock, and a portion of an elongated stretchable textile data bus.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

There is shown in FIG. 1 one embodiment of wearable audio cable management system 10 of this invention. System 10 includes garment 12 having front 13 and back 15, FIG. 2. System 10, FIG. 1, includes pocket 14 for storing audio playback device 16, FIG. 3, e.g., an iPod®, or similar type audio playback device. System 10 also includes device dock 18 associated with pocket 14. Device dock 18 includes audio connector 20 connectable to audio playback device 16, FIG. 3, e.g., an iPod® or similar type audio playback device. System 10, FIG. 1, also includes jack dock 22, FIG. 2, which includes headphone jack 24 configured to connect to headphone(s) 26, e.g., via headphone plug 28, such as standard type headphones for use with an audio playback device 16. System 10, FIGS. 1 and 2, also includes elongated stretchable textile data bus 30 integrated with garment 12 between device dock 18, FIG. 1, and jack dock 22, FIG. 2. Further details of elongated stretchable textile data bus 30 are disclosed in U.S. Pat. No. 7,559,902 and U.S. Publication No. US2007/0299325, incorporated by reference herein. Elongated stretchable textile data bus 30 eliminates the need to route headphone cables into channels of a garment as found in conventional systems, allows system 10 to be used with high performance fabrics, and is easier to manufacture than conventional systems.

Figure 3:
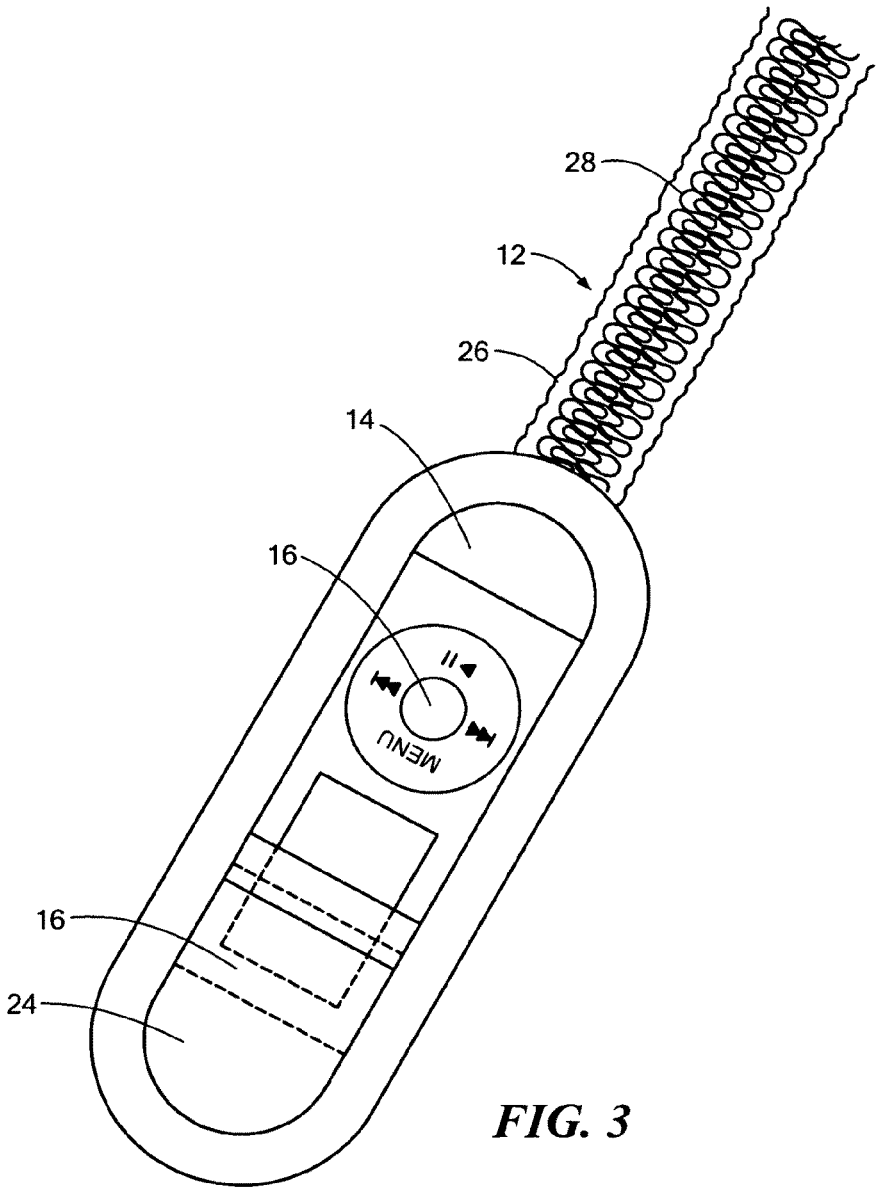
FIG. 3 is a schematic front-view showing in further detail the structure of the pocket and device jack shown in FIG. 1.
Figure 4:
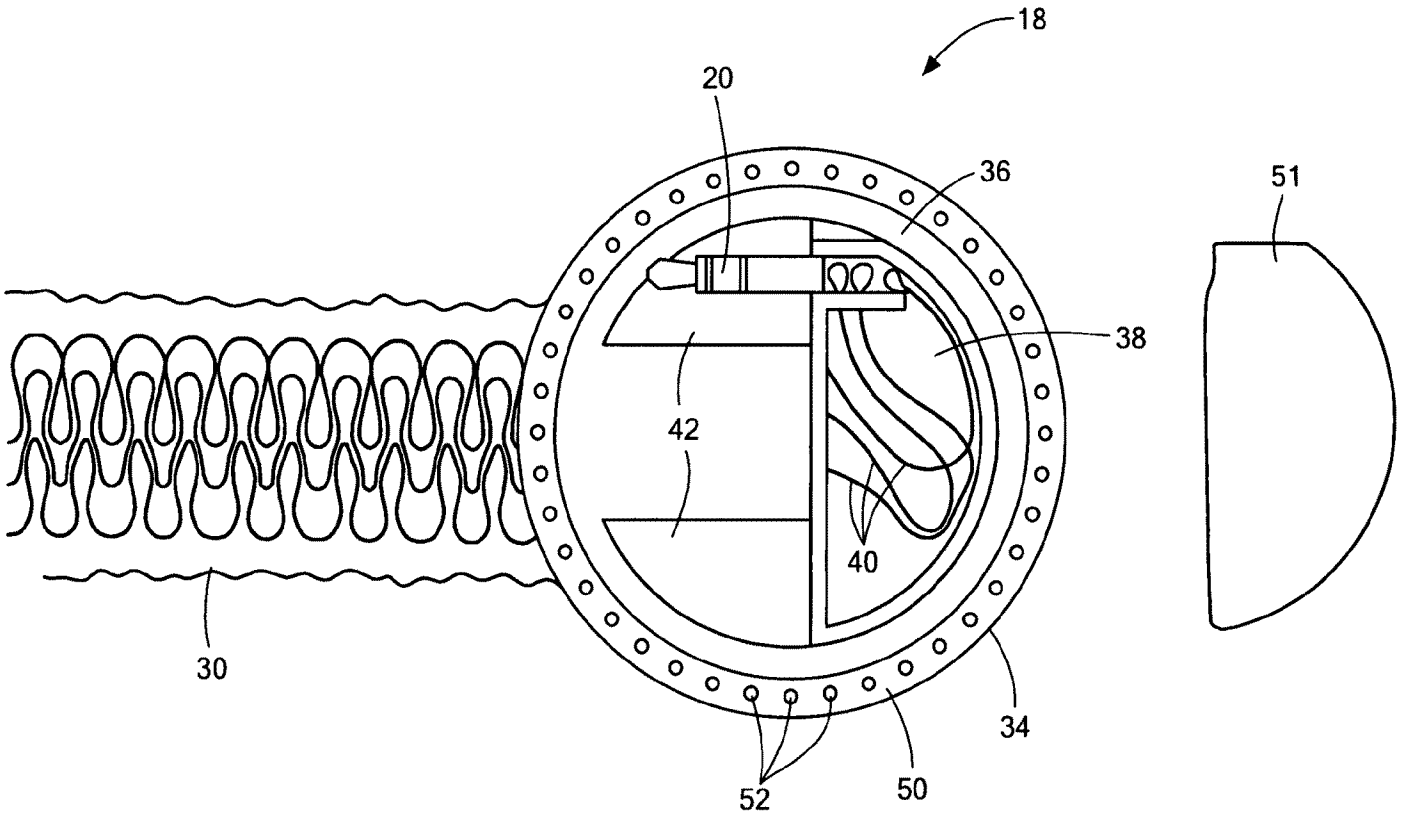
FIG. 4 is a top-view showing in further detail the structure of the device dock shown in FIGS. 1 and 3.

Device dock 18, FIG. 1, preferably includes housing 34, FIG. 4, which defines channel 36 for securing audio connector 20 therein. Housing 34 preferably includes subsystem 38 configured to connect audio connector 20 to data/power bus 30. In one example, wires 40 provide an electrical interconnection between audio connector 20 and data/power bus 30. In one example, housing 34 may include shelf 42, shown in further detail in FIG. 5, which is configured to position audio playback device 16 such that jack 46 of audio playback device 16 engages audio connector 20 of device jack 18, e.g., as shown in FIG. 3. FIG. 6 shows in further detail jack 46 of audio playback device 16 and audio connector 20 of device dock 18. Device dock 16 may include cover 51, FIG. 4, which attaches to housing 34.

Figure 5:
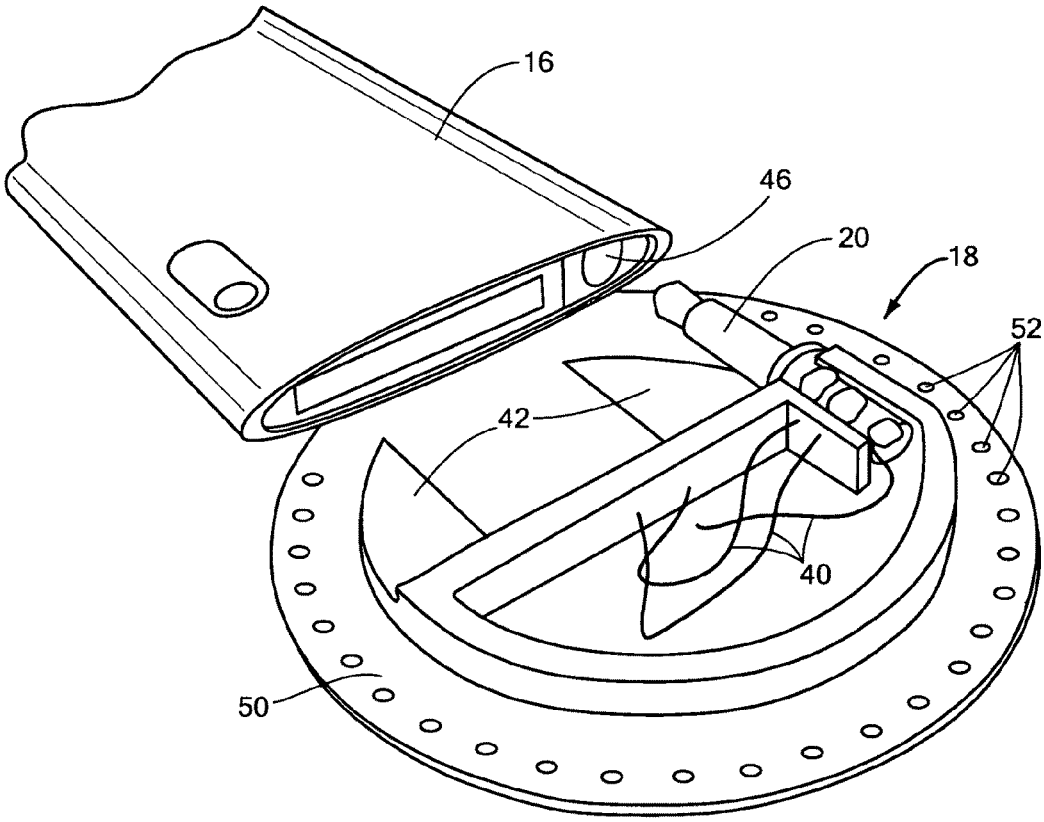
FIG. 5 is a top front-view showing one example of the association of the device dock and the audio playback device shown in FIGS. 1, 3, and 4.
Figure 6:
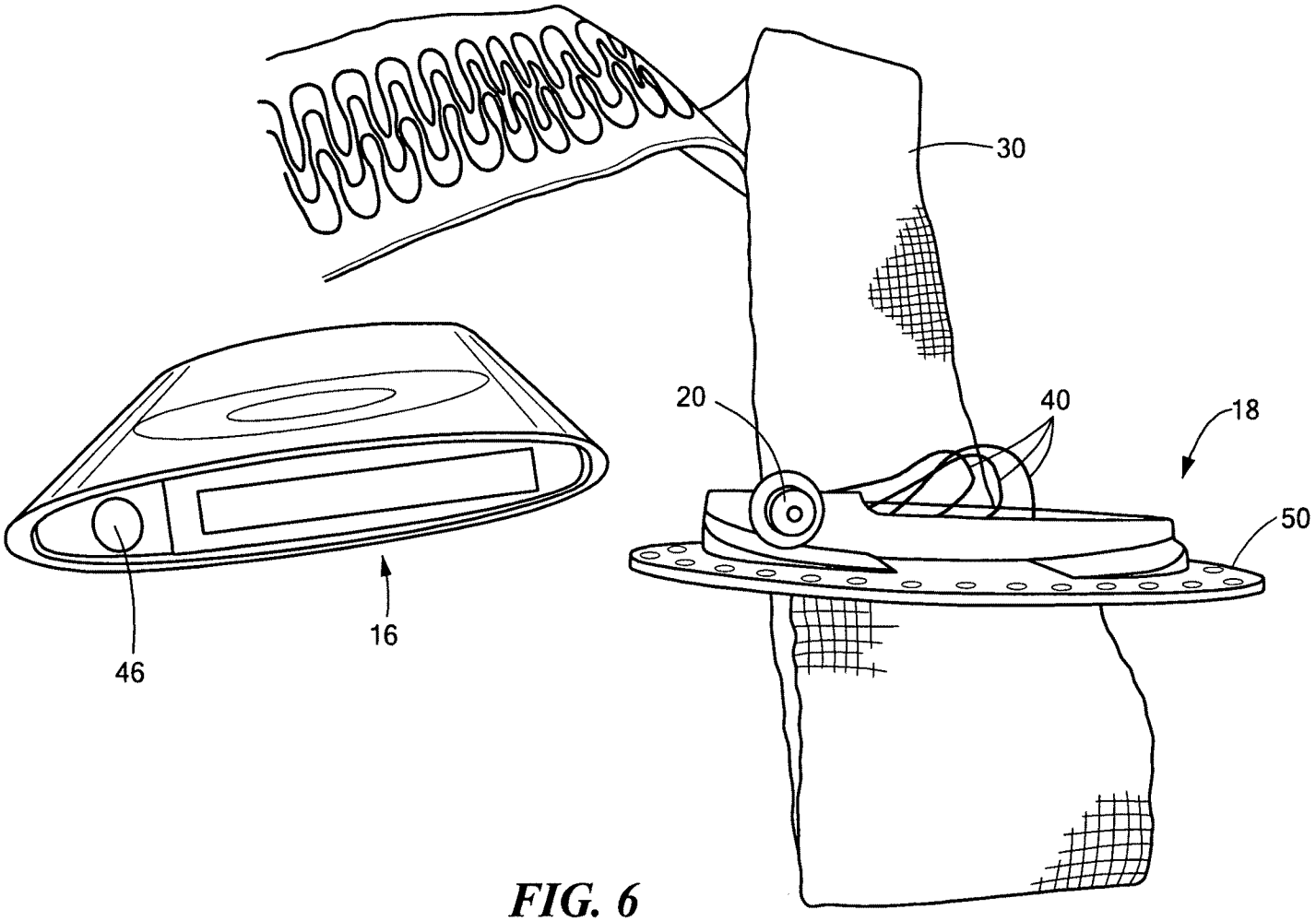
FIG. 6 is a side-view showing another example of the association of the audio playback device and the device dock.

In one embodiment, device dock 18, FIGS. 4-6, includes flange 50 for securing device dock 18 to garment 12, FIG. 1. In one example, flange 50, FIG. 5, includes a plurality of openings 52 which provide for attaching device dock 18 to garment 12 via thread or similar type material. In one example, device dock 18 may be located on front 13 of garment 12, e.g., near lower portion 17. This location allows a user to easily view and control audio playback device 16. In other examples, device dock 18 may be located on any desired location on front 13 or back 15 of garment 12.

Figure 2:
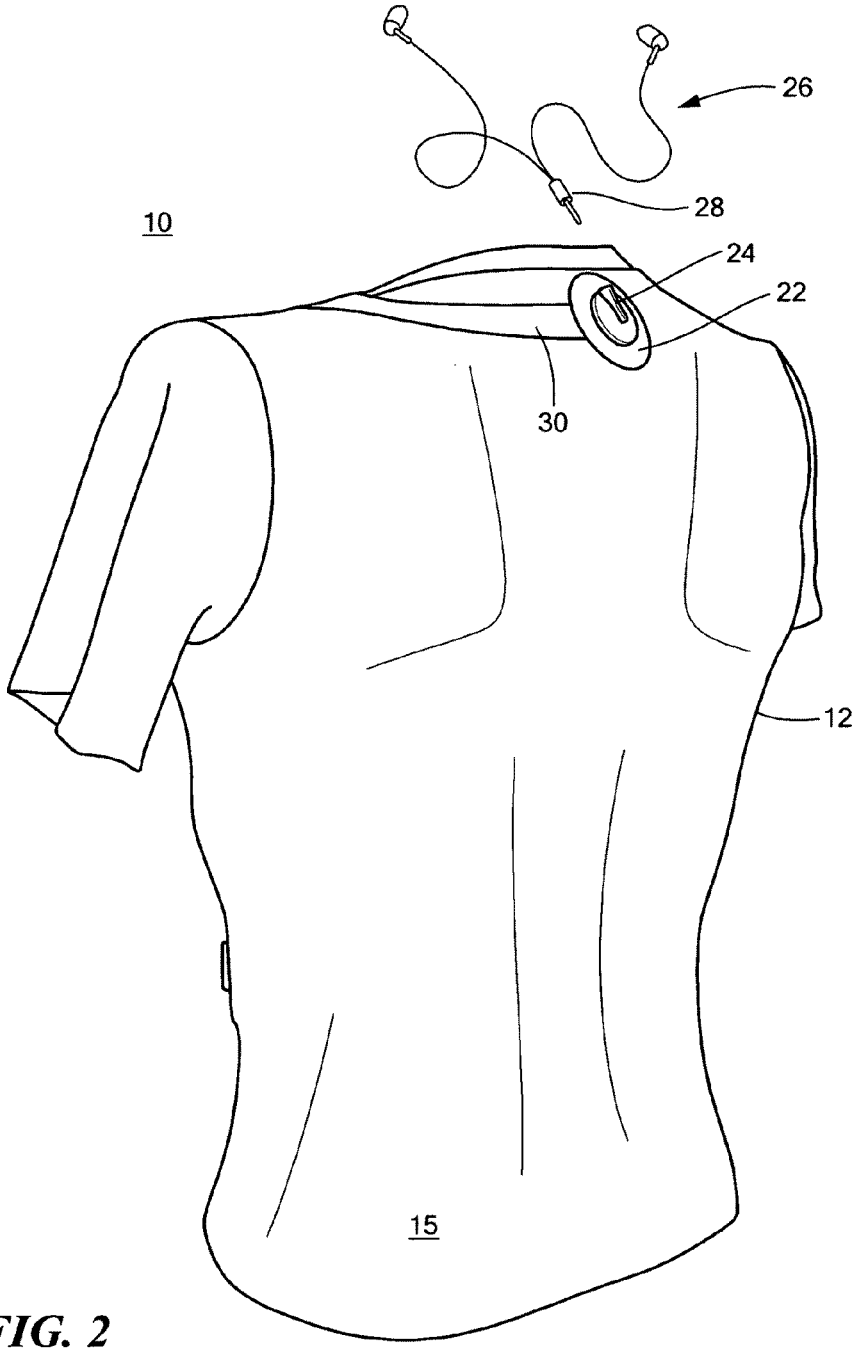
FIG. 2 is a schematic back-view of the system shown in FIG. 1 showing one example of the jack dock of this invention.
Figure 7:
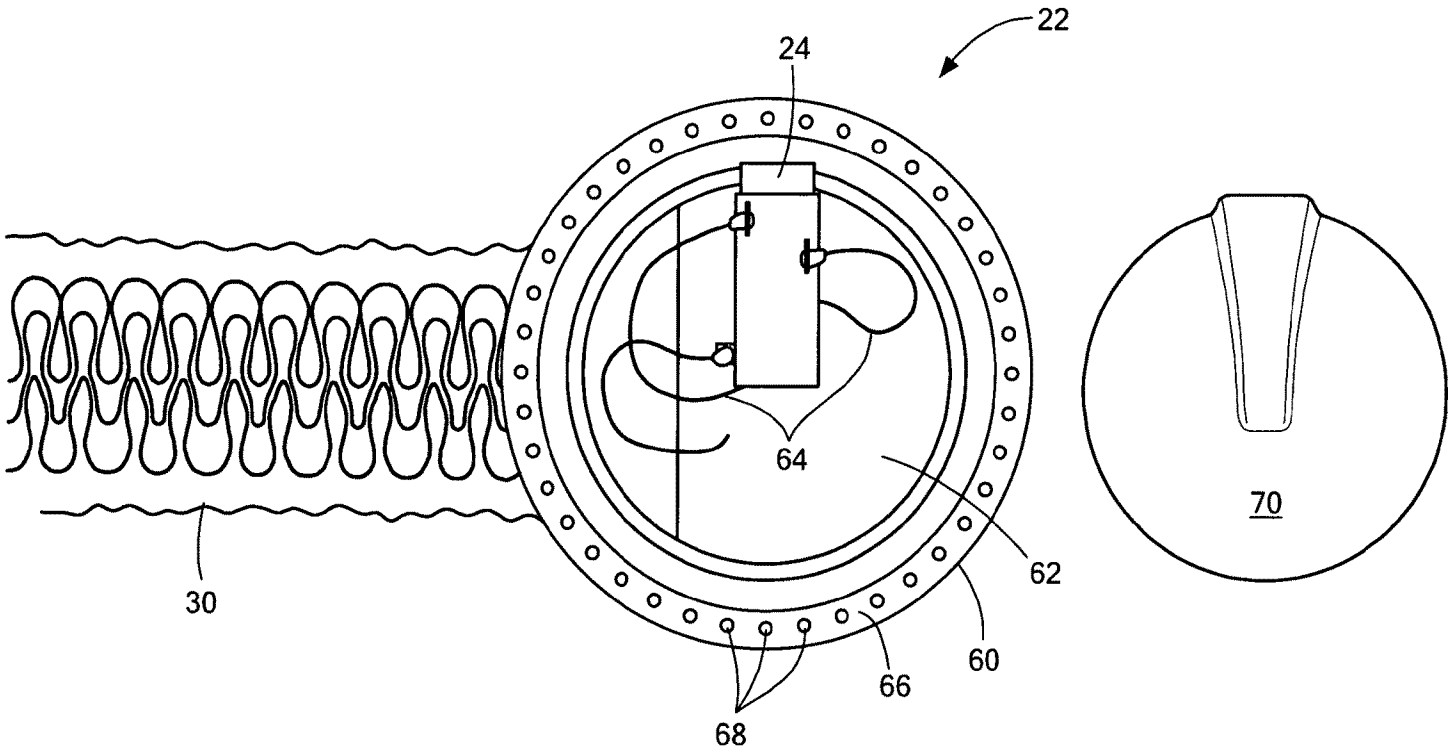
FIG. 7 is a top-view showing in further detail the structure of the jack dock shown in FIG. 2.

Jack dock 22, FIG. 2, preferably includes housing 60, FIG. 7, configured to secure headphone jack 24 therein. Housing 60 preferably includes subsystem 62 configured to connect headphone jack 24 to data/power bus 30. In one example, wires 64 provide an electrical interconnection between headphone jack 24 and data/power bus 30. Headphone dock 22 also preferably includes flange 66 which is configured to secure jack dock 22 to garment 14, FIG. 2. In one example, jack dock 22 may on back 15 of garment 12, e.g., near neck portion 19. In other examples, jack dock 22 may be located on any desired location on front 13, FIG. 1, or back 15, FIG. 2, of garment 12. Similarly, as discussed above with reference to FIG. 5, flange 66 may include a plurality of openings 68 used to connect jack dock 22 to garment 14, e.g., with thread or similar type material know to those skilled in the art. In one example, jack dock 22 may include cover 70 which attaches to housing 60.

Figure 8:
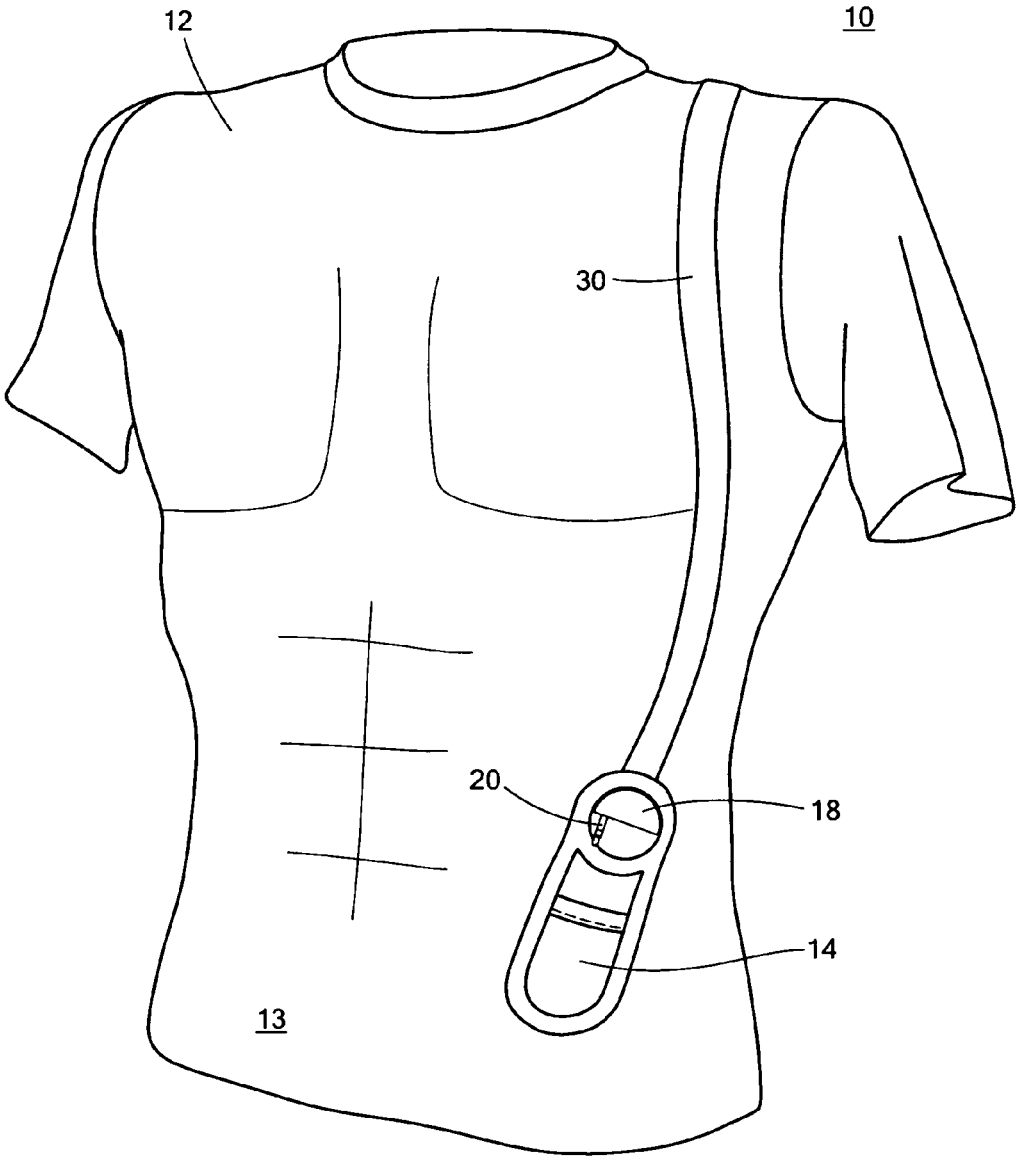
FIG. 8 is a photograph showing one example of a prototype of the system shown in FIG. 1.
Figure 9:
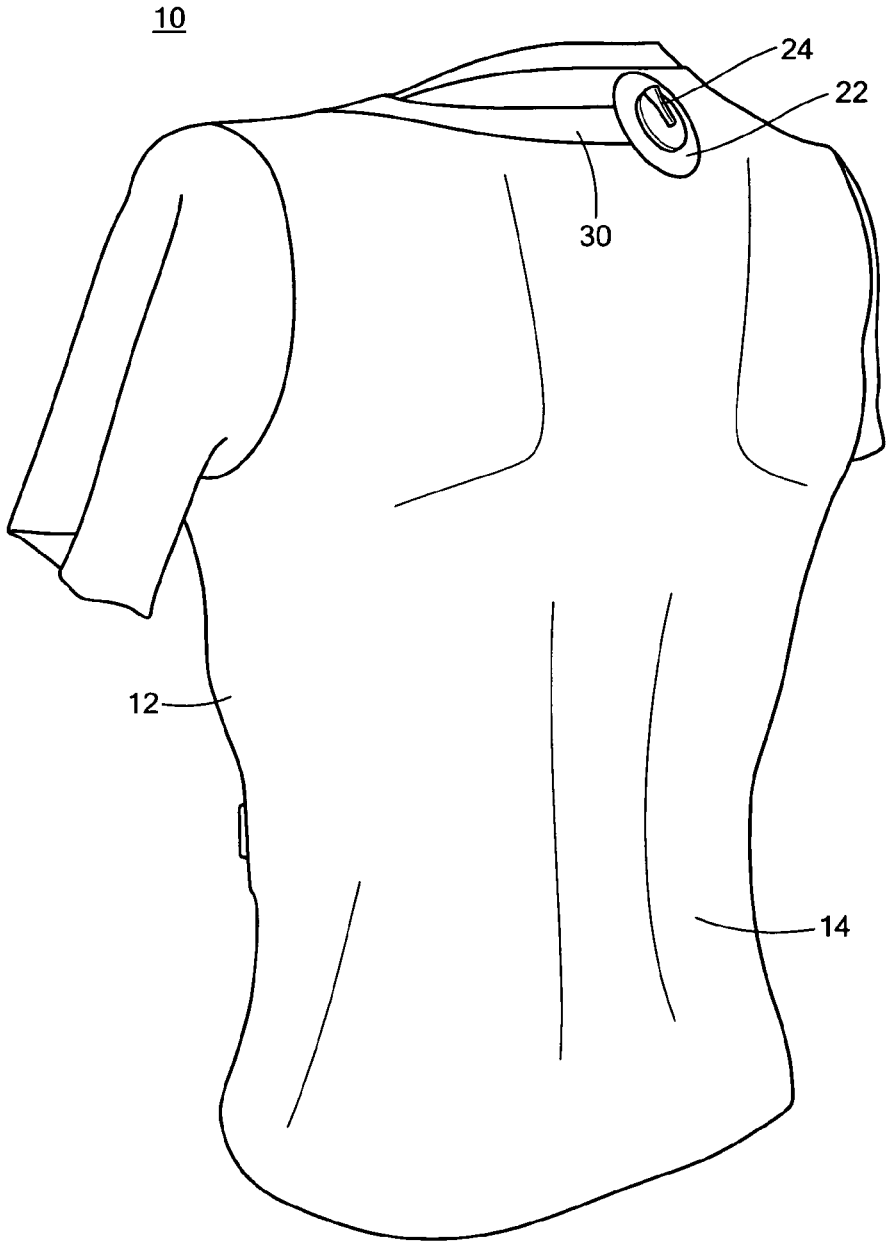
FIG. 9 is a photograph showing one example of a prototype of the system shown in FIG. 2.

FIG. 8, where like parts include like numbers, show one example of an actual prototype of wearable audio cable management system 10 showing garment 12, pocket 14, device dock 18, audio connector 20, and elongated stretchable textile data bus 30. FIG. 9 is a photograph depicting the back of system 10, showing jack dock 22, headphone jack 24 and data/power bus 30.

Figure 10:
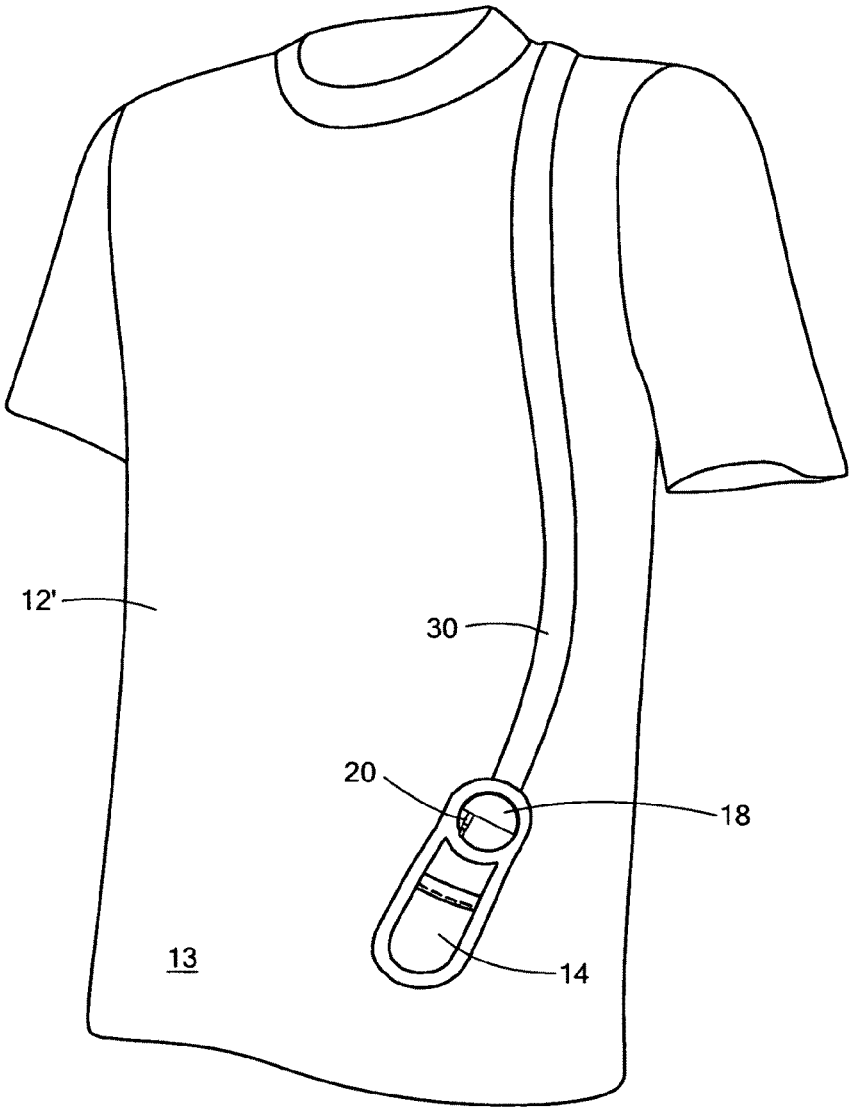
FIG. 10 is a schematic front-view showing one example of the system shown in FIG. 1 on a loose-fitting garment.
Figure 11:
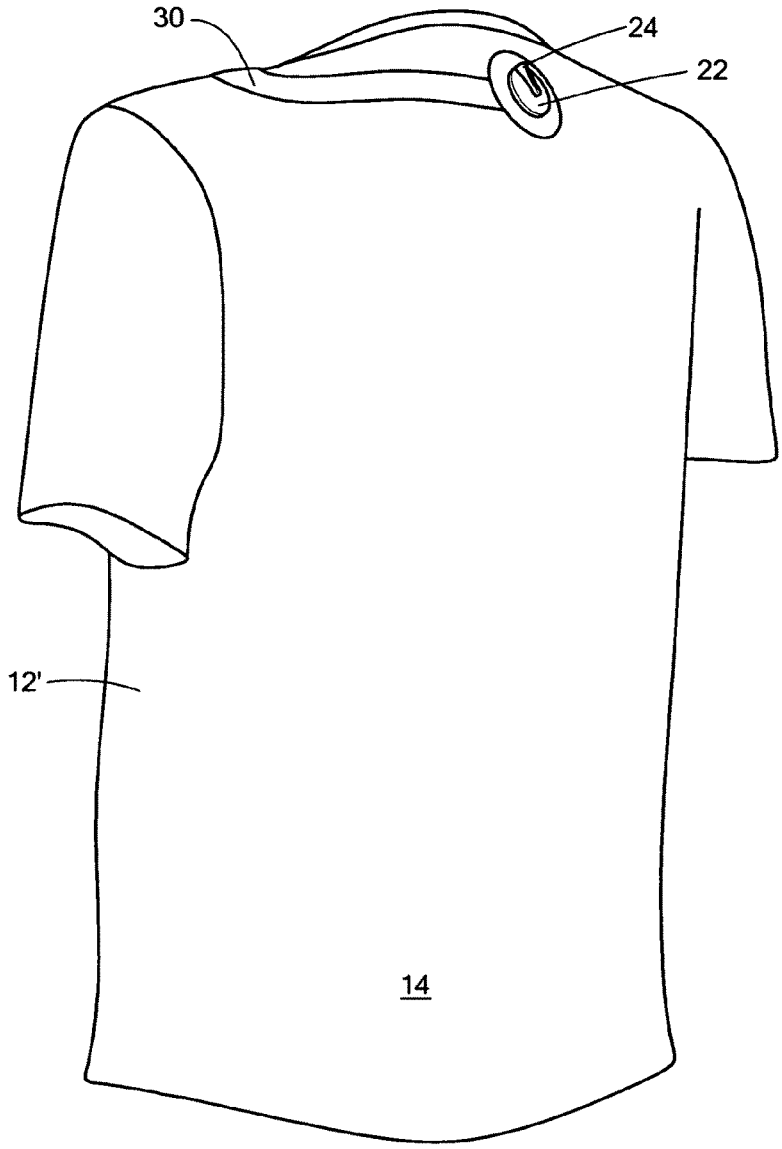
FIG. 11 is a schematic back-view showing one example of the system shown in FIG. 2 on a loose-fitting garment.

As shown in FIGS. 1, 2, 8, and 9, system 10 includes garment 12 that is tight-fitting, in other embodiments, system 10 may include garment 12', FIGS. 10 and 11, where like parts have been given like numbers, that is loose-fitting.

The result is the pocket on the garment secures the audio playback device at a convenient location on a garment, e.g., a lower portion on the front of the garment that allows a user to easily view and control the audio playback device. The wearable audio cable management system also includes a device dock associated with the pocket that includes an audio connector that connects to the audio playback device. The jack dock with a headphone jack, in one example, located near a neck portion on the back of the garment, provides for connecting to a headphone(s). The integrated stretchable data/power bus eliminates the need to route headphone cables into channels of a garment, can be used with high performance fabrics, and is easier to manufacture.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A wearable audio cable management system comprising:

a garment having a front and a back;

a pocket on the garment configured to store an audio playback device;

a device dock associated with the pocket, the device dock including a housing defining a channel for securing an audio connector connectable to the audio playback device, the housing including a subsystem configured to connect the audio connector to an elongated stretchable textile data/power bus;

a jack dock on the garment, the jack dock including a housing for securing a headphone jack configured to connect to a headphone; and the elongated stretchable textile data/power bus integrated with the garment between the device dock and the jack dock.

2. The system of claim 1 in which the pocket and the device dock are located on the front of the garment.

3. The system of claim 2 in which the pocket and the device dock are located on a lower front portion of the garment.

4. The system of claim 1 in which the jack dock is located on the back of the garment.

5. The system of claim 4 in which the jack dock is located near a neck portion of the garment.

6. The system of claim 1 in which the housing of the device dock includes a shelf configured to position the audio playback device such that a jack of the audio playback device engages the audio connector.

7. The system of claim 1 further including a cover attached to the housing of the device dock.

8. The system of claim 1 in which the housing of the device dock includes a flange configured to secure the device dock to the garment.

9. The system of claim 1 in which the housing of the jack dock includes a subsystem configured to connect the headphone jack to the data/power bus.

10. The system of claim 1 in which the housing of the jack dock includes a flange configured to secure the jack dock to the garment.

11. The system of claim 1 in which the garment is tight-fitting.

12. The system of claim 1 in which the garment is loose-fitting.

13. A wearable audio cable management system comprising:

a garment having a front and a back;

a pocket on the front of the garment configured to store an audio playback device;

a device dock associated with the pocket, the device dock including a housing defining a channel for securing an audio connector connectable to the audio playback device, the housing including a subsystem configured to connect the audio connector to an elongated stretchable textile data/power bus;

a jack dock on the back of the garment, the jack dock including a housing for securing a headphone jack configured to connect to a headphone; and the elongated stretchable textile data/power bus integrated with the garment between the device dock and the jack dock.

14. The system of claim 13 in which the jack dock is located near a neck portion of the garment.

* * * * *